United States Patent [19]

Knox, Jr. et al.

[11] Patent Number: 4,570,863

[45] Date of Patent: Feb. 18, 1986

[54] WET GRINDING MACHINE

[75] Inventors: Arthur C. Knox, Jr., 525 Purcell Ave., Cincinnati, Ohio 45205; Allan E. Hokanson, Springfield Township, Hamilton County, Ohio; Anthony Witsken, 525 Purcell Ave., Cincinnati, Ohio 45205

[73] Assignees: C. Arthur Knox; Anthony Witsken, both of Cincinnati, Ohio

[21] Appl. No.: 456,825

[22] Filed: Jan. 10, 1983

[51] Int. Cl.[4] ..... B02C 23/36

[52] U.S. Cl. ..... 241/33; 241/46.06; 241/74; 241/80

[58] Field of Search ..... 241/74, 97, 80, 33, 241/34, 46.02, 46.06, 46.15, 46.08, 46.11, 46.17, 62, 21, 95, 84.2, 86.1, 88.4, 46.13; 366/302-307; 415/121 B

[56] References Cited

U.S. PATENT DOCUMENTS

| | | | |
|---|---|---|---|
| 1,951,684 | 3/1934 | Wells | 241/74 |
| 2,480,085 | 8/1949 | Mitchell | 241/80 X |
| 2,491,231 | 12/1949 | Travis et al. | 366/302 |
| 3,307,791 | 3/1967 | Nagai | 341/74 |
| 3,330,488 | 7/1967 | Muller | 241/89.3 X |
| 3,695,520 | 10/1972 | Mauro | 241/46.11 X |
| 3,894,694 | 7/1975 | Rothman | 241/46.11 |
| 3,912,236 | 10/1935 | Zipperer et al. | 366/303 X |
| 4,096,057 | 6/1978 | Porritt et al. | 241/74 X |

FOREIGN PATENT DOCUMENTS

| | | | |
|---|---|---|---|
| 1117546 | 2/1953 | Fed. Rep. of Germany | 366/305 |
| 1485396 | 6/1967 | France | 241/46.11 |

*Primary Examiner*—Mark Rosenbaum

*Attorney, Agent, or Firm*—James W. Pearce; Roy F. Schaeperklaus

[57] ABSTRACT

A wet grinding machine which includes a grinder head, an annular stator mounted on the grinder head, and a rotor rotatably mounted in the grinder head. Shearing blades on the rotor turn inside the stator and sweep across shearing slots in the stator. Each of the shearing slots slopes and overlaps adjacent shearing slots so that each of the blades is constantly addressing an inner edge of at least one of the shearing slots. A classifying screen chamber surrounds the stator but is independent of the grinding machine so that particles of reduced size can pass through the screen to be removed while larger particles are retained and sheared by the rotor blades against inner edges of the slots.

8 Claims, 13 Drawing Figures

FIG. 6
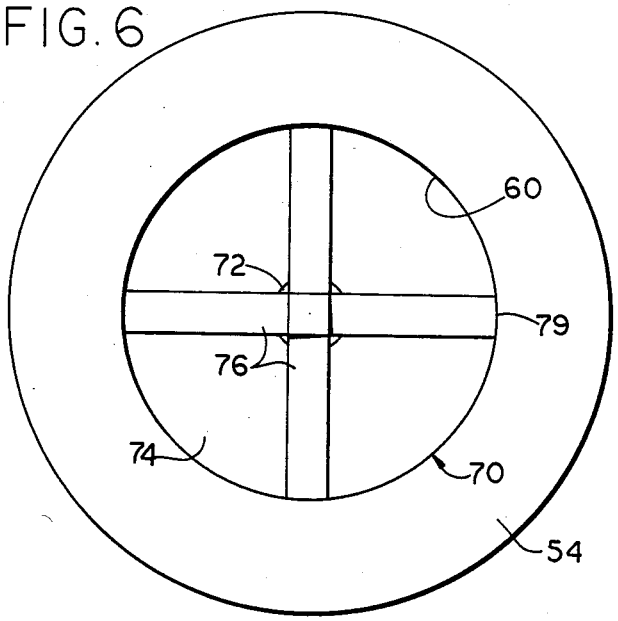
FIG. 7
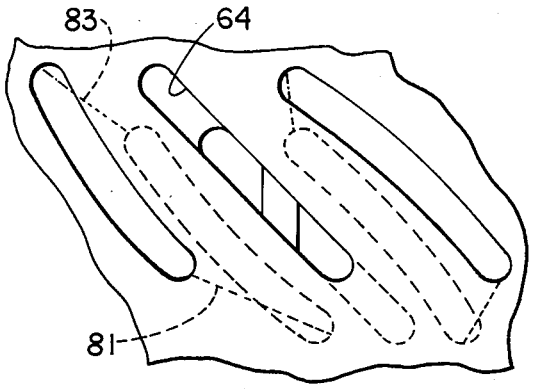
FIG. 9
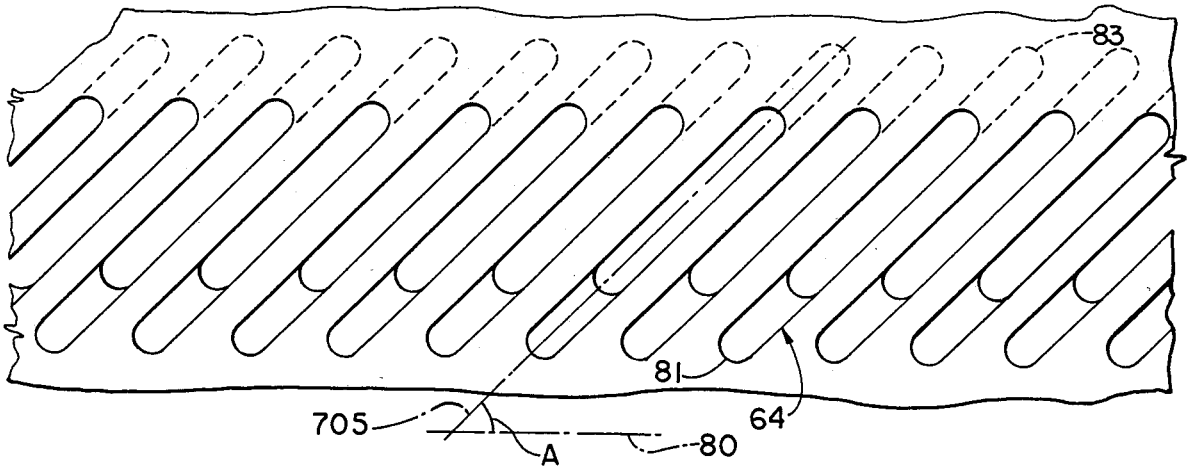
FIG. 10
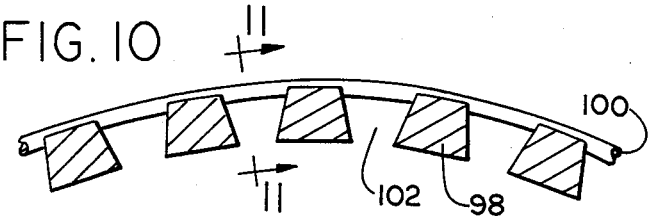
FIG. 11
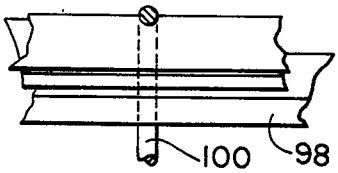
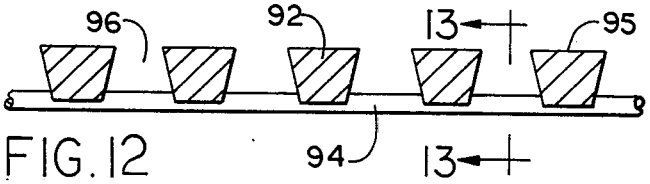
FIG. 12
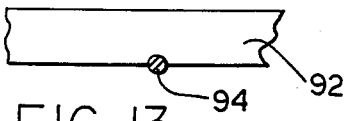
FIG. 13

WET GRINDING MACHINE

This invention relates to a device for continuous grinding and coincident classification of solids in a liquid.

An object of this invention is to provide a device which can grind whole grain, such as corn or the like, or other solids, as required in producing a mash or slurry as preparation for further processes such as liquidification for the fermentation industries.

A further object of this invention is to provide such a machine which can continuously classify particles by recirculating large particles while removing particles which are of sufficiently small size to be within the classification.

A further object of this invention is to provide various particle size classifications from one and the same grinding device allowing the classification to be independent of the grinding device.

Briefly, this invention provides a wet grinding machine which includes a grinder head, an annular stator mounted on and extending downwardly from the grinder head, and a rotor rotatably mounted in the grinder head, all constituting a grinding assembly. Upright shearing blades on the rotor turn inside the stator. A plurality of shearing slots in the stator are opposed to or addressed by the blades. Each of the shearing slots slopes and overlaps adjacent shearing slots so that each of the blades is constantly addressing at least one of the shearing slots. The stator extends downwardly from the slots to an inlet opening spaced from the shearing slots. The rotor is turned to cause the rotor blades to provide a pumping action to induce a slurry entering the stator to pass through the inlet opening and to discharge through the shearing slots. The stator can be supported inside a vessel. A classifying screen can be mounted inside the vessel surrounding the grinding assembly so that particles of classified or reduced size can pass through the screen to be removed from access to the grinding assembly while larger unclassified particles are retained inside the classifying screen for shearing by the rotor blades against inner edges of the slots.

The above and other objects and features of the invention will be apparent to those skilled in the art to which this invention pertains from the following detailed description and the drawings, in which:

FIG. 6 is a view in bottom plan looking in the direction of the arrows 6—6 in FIG. 5;

FIG. 7 is a fragmentary view in side elevation looking in the direction of the arrows 7—7 in FIG. 5;

FIG. 9 is a developed view showing inner ends of stator slots of the machine;

FIG. 10 is a fragmentary view in section taken on the line 10—10 in FIG. 1;

FIG. 11 is a view in section taken on the line 11—11 in FIG. 10;

FIG. 12 is a fragmentary view in section taken on the line 12—12 in FIG. 1; and FIG. 13 is a view in section taken on the line 13—13 in FIG. 12.

In the following detailed description and the drawings, like reference characters indicate like parts.

Figure 1:
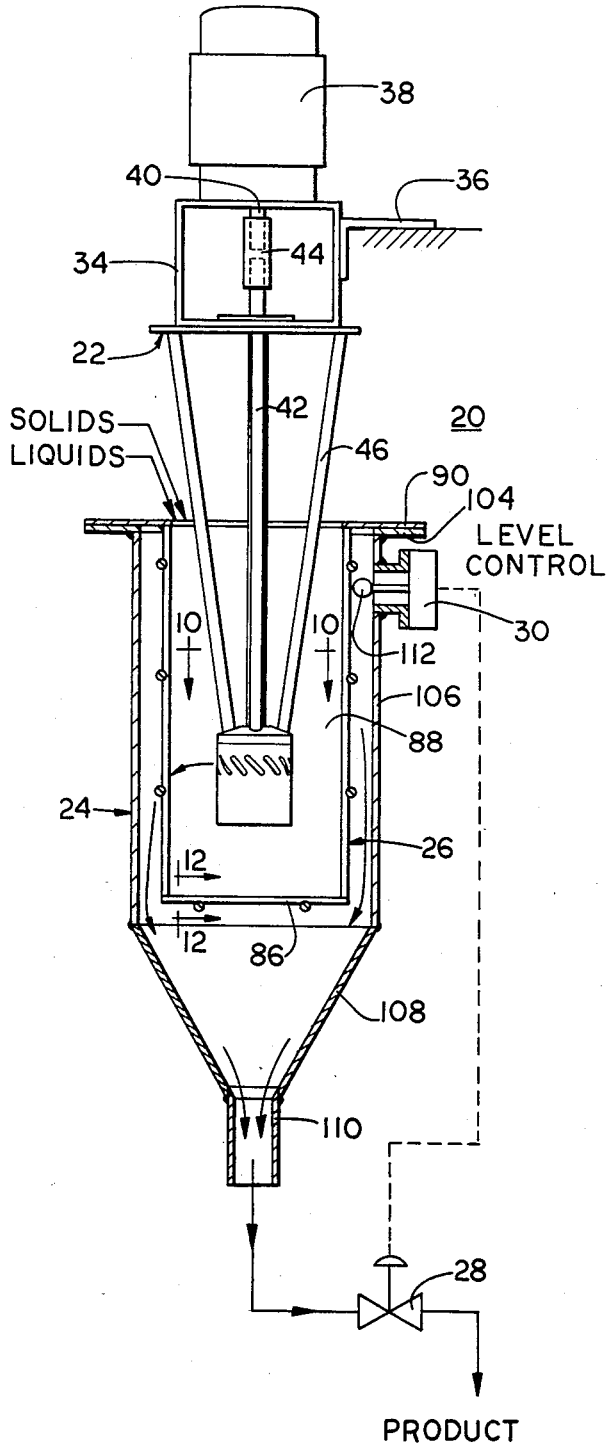
FIG. 1 is a somewhat schematic view in transverse section of a machine for continuous grinding and classifying particulate material, which is constructed in accordance with an embodiment of this invention.

In FIG. 1 is shown a wet grinding machine 20 constructed in accordance with an embodiment of this invention. The machine 20 includes a grinding assembly 22, a chamber or vessel 24, and a classifying screen assembly 26. Associated therewith are an outlet valve 28 and a liquid level controller 30, which are shown diagrammatically.

Figure 2:
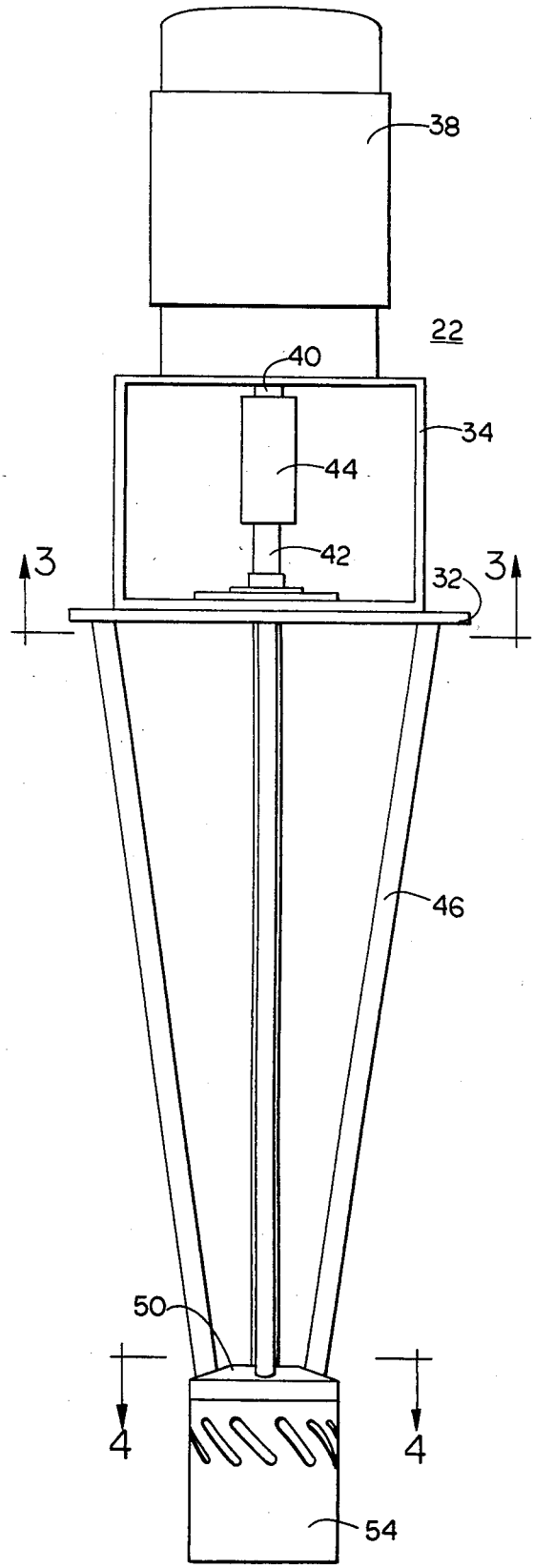
FIG. 2 is a view in side elevation on an enlarged scale of a grinding assembly of the machine.
Figure 3:
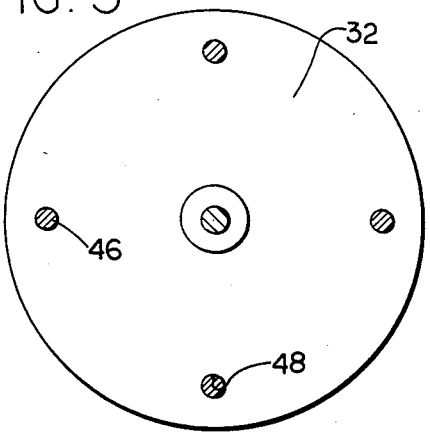
FIG. 3 is a view in section taken on the line 3—3 in FIG. 2.
Figure 4:
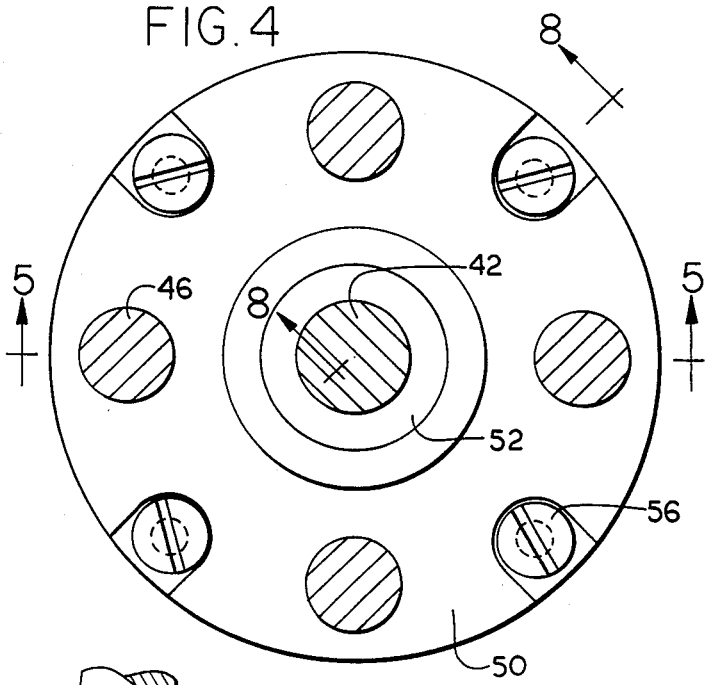
FIG. 4 is a view in section taken on an enlarged scale on the line 4—4 in FIG. 2.

The grinding assembly 22 (FIG. 2) includes a base plate 32 on which a support cage 34 is mounted. The cage 34 is supported by an appropriate support 36, not shown in detail. A motor 38 is supported on the cage 34. The motor drives a shaft 40, which is coupled to a main drive shaft 42 by a coupling 44.

Four support rods 46 are mounted in openings 48 in the base plate 32. Lower end portions of the rods 46 are mounted in sockets 49 (FIG. 5) in a grinder head 50, as by welding, to support the grinder head 50 so that the grinder head 50 is supported by the rods 46, the base plate 32 and the cage 34. The main drive shaft 42 extends through a bearing 52 mounted in the grinder head 50.

An annular stator member or shroud 54 is mounted on the grinder head 50 by means of bolts 56. The stator 54 includes an upper portion 58 having a cylindrical inner face 60 and a cylindrical outer face 62. Generally radially extending transverse slots 64 are provided in the upper portion 58. The slots 64 intersect the inner face 60 and the outer face 62. An elongated lower portion 65 of the stator member 54 includes an inner face 66 which slopes downwardly and outwardly. A cylindrical outer face 68 of the lower portion 65 is aligned with the cylindrical outer face 62 of the upper portion 58. An inlet opening 116 for the stator is provided at the lower end of the lower portion 65.

Figure 5:
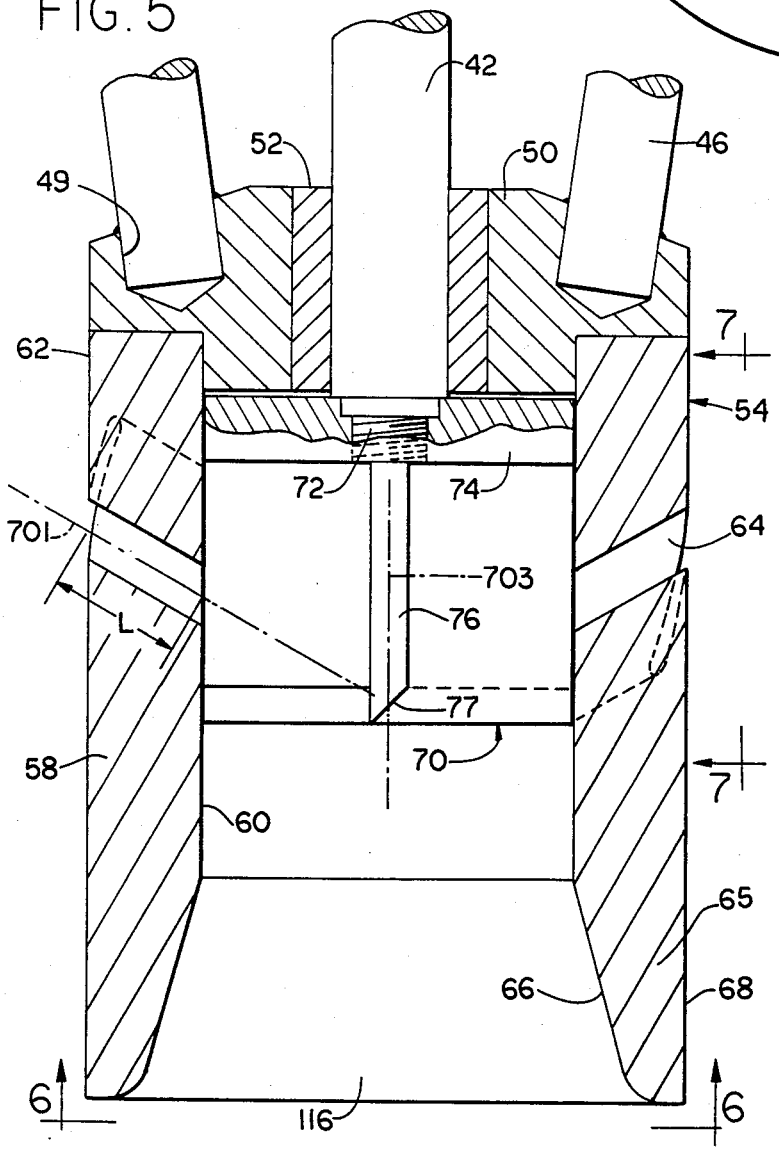
FIG. 5 is a view in section taken on the line 5—5 in FIG. 4.
Figure 8:
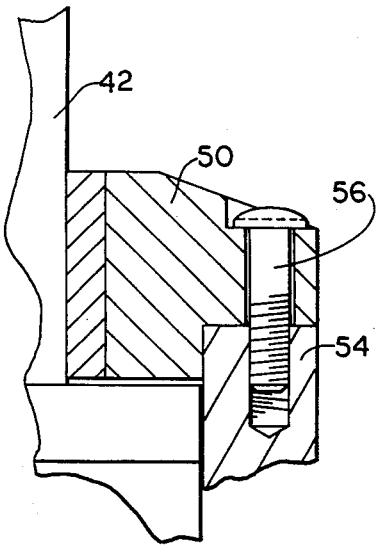
FIG. 8 is a view in section taken on the line 8—8 in FIG. 4.

As shown in FIG. 5, a center line 701 of each of the slots 64 extends outwardly and upwardly at an angle of approximately 60 degrees to the axis 703 of the stator 54. Each of the slots 64 is elongated, as shown in FIG. 9. A major axis 705 of each of the slots 64 extends at an angle A of approximately 45 degrees to a horizontal plane 80. A typical slot 64 slopes from a lower edge 81 to an upper edge 83. For best results, the center line length L of each slot is such that the length L is in a range of 1.3 to 4.0 times the nominal slot diameter (the diameter of a circle of area equal to the cross-sectional slot area taken perpendicularly to the center line 701).

A rotor 70 is mounted on an axial stud portion 72 of the main drive shaft 42. The rotor includes an upper plate portion 74 and blades 76. A lower end portion 77 of each blade is cut away at an angle of 45 degrees to the axis 703. The blades 76 sweep the inner face 60 of the upper cylindrical portion 58 of the stator 54. Outer edge faces 79 of the blades 76 sweep across inner ends of the slots 64 in closely spaced shearing relation to the inner face 60 of the upper cylindrical portion 58 of the stator to sheer solid particles as the solid particles enter the slots 64. The blades are approximately upright as shown in FIGS. 5 and 6. As the rotor 70 turns, the blades 76 sweep across the inner ends of the slots 64 with each blade intersecting at least one slot 64 at all times so that there is a continuous shearing action between each blade 78 and the inner shear edge of the slot or slots opposed to the blade.

A slurry of large solids and liquid can be introduced into the interior of the classifier assembly 26, and the large solids are retained inside the classifier screen assembly 26 until reduced to an acceptable size by the grinding machine, at which the reduced particles can pass through the classifier screen assembly 26. The classifier screen assembly 26 includes a flat round bottom portion 86, a cylindrical portion 88 and an annular support flange member 90. The bottom portion 86 includes a plurality of parallel bar members 92 (FIGS. 11 and 12) which are connected together by tie rods 94 welded thereto exterior to classifying surfaces 95 thereof. Each of the bar members 92 is of trapezoidal cross-section, and the bar members 92 are arranged to form classifying slots 96 between ends of trapezoid long bases of the bar members 92, openings between the bar members enlarging in an outward direction to a maximum width between trapezoid short bases of the bar members 92. The cylindrical portion 88 includes a plurality of parallel bar members 98, which are connected by circular tie rods 100 welded thereto. Each of the bar members 98 is of trapezoidal cross-section, and the bar members 98 are arranged to form classifying slots 102 between ends of trapezoid long bases of the bar members 98, openings between the bar members 98 enlarging in an outward, radial direction.

The round bottom portion 86 and the cylindrical portion 88 can be welded together. The annular support flange member 90 is welded to the upper end of the cylindrical portion 88 and can rest on a flange member 104 of the vessel 24.

The vessel 24 includes the flange member 104, a cylindrical main portion 106 inside which the cylindrical portion 88 and the flat portion 86 of the screen assembly 26 are mounted, an inverted conical lower portion 108, and a bottom discharge fitting 110.

As large solid particles are ground while suspended in the liquid to form a slurry of particles of reduced size, additional large solid particles and liquid can be added to the interior of the classifier screen assembly 26 as the slurry of particles of reduced size and liquid is withdrawn from the bottom of the vessel 24 through the valve 28. Rotation of the rotor induces a pumping action driving the particles of reduced size through the slots 64 in the stator 54. The liquid level controller 30 has a sensor 112 which senses the height of liquid in the vessel 24. The liquid level controller 30 is constructed to maintain a constant level of liquid in the vessel 24 surrounding the classifier screen assembly 26.

The elongated lower portion 65 of the annular stator 54 guides the slurry of water and large particles of solids to the rotor 70. The slurry of water and large particles enters the lower open end or inlet opening 116 of the stator 54 and progresses upwardly to the rotor 70. The blades 76 of the rotor force the slurry of large particles outwardly through the slots 64. As the large particles enter the slots 64, the solids and liquid are sheared by the blades 76 against inner edges of the slots 64, and the solid particles are reduced in size. The slurry of particles of reduced size is jetted from the slots 64 outwardly to the classifier screen assembly 26, and particles of reduced and appropriate size can pass through the classifier screen assembly and are expelled from the interior of the classifier screen assembly. Oversize particles are retained inside the classifier screen assembly for regrinding to appropriate size. The open lower end or inlet opening 116 of the stator 54 is spaced sufficiently from the slots 64 that newly sheared particles tend to pass through the classifier screen assembly 26 without being recycled.

The wet grinding machine illustrated in the drawings and described above is subject to structural modification without departing from the spirit and scope of the appended claims.

Having described our invention, what we claim as new and desire to secure by letters patent is:

1. A wet grinding machine which comprises a grinder head, an annular stator mounted on the grinder head, a rotor rotatably mounted in the grinder head, upright shearing blades on the rotor turnable inside the stator, there being a plurality of shearing slots in the stator opposed to the blades, each of the shearing slots sloping and overlapping adjacent shearing slots, whereby, as the rotor turns, each of the blades is constantly opposed to and addressing at least one of the shearing slots, the stator extending downwardly from the slots to an inlet opening spaced from the shearing slots, and means for turning the rotor to cause the rotor vanes to induce pumping of a slurry of large particles in liquid entering the stator through the inlet opening to cause the large particles to enter the shearing slots to be sheared by the blades against inner edges of the slots to form particles of reduced size, liquid discharged from the shearing slots recirculating through the inlet opening.

2. A wet grinding machine as in claim 1 which includes a classifying screen chamber surrounding but independent of the stator, the particules of reduced size passing through a classifying screen of the classifying screen chamber to be expelled from the classifying screen chamber while large particles are retained in the classifying screen chamber for grinding to classified size.

3. A wet grinding machine as in claim 2 which includes a vessel surrounding the classifying screen chamber, means for introducing solids and liquid into the interior of the classifying screen chamber, and means for withdrawing a slurry of particles of classified size from the vessel containing the classifying screen chamber.

4. A wet grinding machine as in claim 3 which includes a liquid level controller actuated by the level of fluid in the vessel and a flow control valve controlling flow of fluid from the vessel and actuated by the liquid level controller when the level of fluid in the vessel exceeds a selected level to permit removal of fluid from the vessel.

5. A wet grinding machine as in claim 2 in which the classifying screen chamber can classify particle size continuously.

6. A wet grinding machine which includes a grinder head, an annular stator mounted on the grinder head, a rotor rotatably mounted in the grinder head, upright shearing blades on the rotor turnable inside the stator, there being a plurality of shearing slots in the stator opposed to the blades, each of the shearing slots sloping and overlapping a plurality of adjacent shearing slots, whereby, as the rotor turns, each of the blades is constantly opposed to and addressing at least one of the shearing slots, there being an inlet opening in the stator, means for turning the rotor to cause the rotor blades to induce a slurry to flow through the inlet opening to the shearing slots and to shear particles of a slurry entering the shearing slots, and a screen surrounding and spaced from the stator, particles of reduced size passing through the screen to be removed while large particles are recirculated to be sheared by the rotor blades.

7. A wet grinding machine as in claim 6 which includes a vessel surrounding the screen, means for introducing liquid and large particles into the interior of the screen, and means for withdrawing a slurry of particles of reduced size from the vessel outside the screen.

8. A wet grinding machine as in claim 7 which includes a liquid level controller actuated by the level of fluid in the vessel and a flow control valve controlling flow of fluid from the vessel and actuated by the liquid level controller when the level of fluid in the vessel exceeds a selected level to permit removal of fluid from the vessel.

* * * * *